US006116046A

United States Patent [19]

Leaver et al.

[11] Patent Number: 6,116,046

[45] Date of Patent: Sep. 12, 2000

[54] REFRIGERATION CHILLER WITH ASSURED START-UP LUBRICANT SUPPLY

[75] Inventors: Daniel C. Leaver; Sean A. Smith, both of La Crosse, Wis.

[73] Assignee: American Standard Inc., Piscataway, N.J.

[21] Appl. No.: 09/263,389

[22] Filed: Mar. 5, 1999

[51] Int. Cl.[7] ..... F25B 43/02

[52] U.S. Cl. ..... 62/473; 62/193; 62/192; 62/470; 62/84

[58] Field of Search ..... 62/193, 192, 473, 62/470, 84

[56] References Cited

U.S. PATENT DOCUMENTS

| | | | |
|---|---|---|---|
| 4,112,701 | 9/1978 | Schibbye et al. | 62/84 |
| 4,180,986 | 1/1980 | Shaw | 62/192 |
| 4,497,185 | 2/1985 | Shaw | 62/470 |
| 4,662,190 | 5/1987 | Tischer | 62/470 |
| 5,134,856 | 8/1992 | Pillis et al. | 62/193 |
| 5,419,155 | 5/1995 | Boehde et al. | 62/470 |
| 5,553,460 | 9/1996 | Isaacs | 62/129 |
| 5,603,227 | 2/1997 | Holden et al. | 62/193 |
| 5,761,914 | 6/1998 | Carey et al. | 62/84 |
| 5,765,392 | 6/1998 | Baur | 62/473 |

*Primary Examiner*—William Doerrler
*Assistant Examiner*—Mark Shulman
*Attorney, Agent, or Firm*—William J. Beres; William O'Driscoll; Peter D. Ferguson

[57] ABSTRACT

An assured supply of lubricant to the compressor in a refrigeration chiller is provided by a reservoir that is connected in parallel with the main line by which lubricant is supplied to the compressor. The reservoir is connected to the main lubricant supply line in a manner such that if the lubricant supply line is blown dry, as can occur as a result of an unusual or abnormal chiller shutdown condition, a critical portion of the supply line will be refilled by the reservoir relatively very quickly which assures the immediate availability of lubricant to the compressor from that portion of the lubricant supply line when it next starts up.

27 Claims, 2 Drawing Sheets

REFRIGERATION CHILLER WITH ASSURED START-UP LUBRICANT SUPPLY

BACKGROUND OF THE INVENTION

The present invention relates to refrigeration chillers, to the compressors by which they are driven and to the lubrication thereof. With still more particularity, the present invention relates to refrigeration chillers driven by screw compressors and apparatus by which to ensure the immediate availability of lubricant to the compressor at chiller start-up.

The primary components of the refrigeration circuit of a refrigeration chiller include a compressor, a condenser, an expansion device and an evaporator. High pressure refrigerant gas is delivered from the compressor to the condenser where the refrigerant gas is cooled and condensed to the liquid state. The condensed high pressure refrigerant passes from the condenser to and through the expansion device. Passage of the refrigerant through the expansion device causes a pressure drop therein and the further cooling thereof. As a result, the refrigerant delivered from the expansion device to the evaporator is cool and is at relatively low pressure.

The refrigerant delivered to the evaporator is brought into heat exchange contact with a tube bundle disposed therein through which a relatively warmer heat transfer medium, such as water, flows. That medium will have been warmed by heat exchange contact with the heat load which it is the purpose of the refrigeration chiller to cool.

Heat exchange contact between the relatively cool refrigerant and the relatively warm heat transfer medium in the evaporator causes the refrigerant to vaporize and the heat transfer medium to be cooled. The now cooled medium is returned to the heat load to further cool it while the now heated, low pressure refrigerant is drawn out of the evaporator and into the compressor in the gaseous state for recompression and delivery to the condenser in a continuous process.

Where the compressor by which a refrigeration chiller is driven is a compressor of the screw type, it is typical that a relatively large amount of compressor lubricant will mix with the refrigerant gas undergoing compression therein and will be carried out of the compressor entrained in the stream of high pressure refrigerant gas discharged therefrom. To a somewhat lesser extent this is also the case in chillers driven by compressors of other than the screw type.

An oil separator will typically be disposed downstream of a screw compressor in a refrigeration chiller for the purpose of disentraining lubricant from the high pressure refrigerant gas in which it is carried out of the compressor. The disentrained oil settles into a sump within the oil separator. The relatively high pressure that exists within the oil separator is used to drive the disentrained lubricant from the sump back to the compressor for purposes such as bearing lubrication, sealing and cooling of the refrigerant gas undergoing compression therein.

Because the disentrained oil is exposed to the relatively high discharge pressure that exists in the oil separator and because it is at relatively high temperature, it will typically absorb and contain on the order of 30% by weight of the refrigerant from which it has been disentrained. When a screw compressor-driven refrigeration chiller is shut down under certain operating circumstances, particularly when operating at or near full load and such as during a power interruption or an emergency stop, the resulting precipitous pressure drop in the high pressure side of the chiller system causes the relatively violent outgassing of the absorbed refrigerant from the oil on that side of the system as well as the gas-driven reverse direction high speed rotation of the no longer motor-driven screw rotors. These effects result from the system's attempt, once it shuts down, to equalize pressures within itself across the compressor and expansion devices which generally define the boundaries of the high and low pressure sides of the refrigeration circuit within a chiller when it is in operation. Under such circumstances, the main oil line connecting the compressor and the sump in the oil separator can be blown dry.

Under such shutdown circumstances, provided that the conditions causing them are transient, the chiller system will attempt to restart relatively quickly after shutting down. If the oil feed line to the compressor has been blown dry, such re-starts can be unsuccessful due to the lack of a sensed supply of oil in the compressor supply line or can, if successful, potentially have the long term effect of damaging the compressor for intermittent lack of lubricant at start-up.

The need exists, in order to assure the long-term reliability of the compressor and to reduce or eliminate repeated unsuccessful attempted chiller re-starts and the service calls that can result therefrom under certain circumstances, for apparatus and/or a method by which to assure lubricant flow to a screw compressor in a refrigeration chiller shortly after chiller start-up even if the nature of the preceding chiller shutdown was such as to cause the oil supply line to the compressor to be blown dry.

SUMMARY OF THE INVENTION

It is an object of the present invention to ensure the availability of lubricant to a screw compressor employed in a refrigeration chiller at start-up irrespective of the conditions under which the chiller previously shut down.

It is another object of the present invention to assure the availability of lubricant to the screw compressor in a refrigeration chiller when it starts up even if the line by which lubricant is supplied to the compressor has been blown dry as a result of the nature of the previous shutdown of the chiller.

It is a still further object of the present invention to assure the supply of lubricant to a screw compressor in a refrigeration chiller, even after the supply line by which lubricant is delivered to the compressor has been blown dry during the previous chiller shutdown, without the need or use of moving parts or controls dedicated to that purpose.

It is another object of the present invention to assure that lubricant is delivered to a screw compressor in a refrigeration chiller shortly after start-up, irrespective of the circumstances of the previous compressor shutdown, so as to both ensure long term compressor reliability and to eliminate repeated failed chiller starts that can occur if lubricant availability to the compressor cannot be confirmed shortly after a compressor re-start is attempted.

These and other objects of the present invention, which will better be appreciated and understood by reference to the following Description of the Preferred Embodiment and the accompanying drawing figures, are accomplished in a screw compressor-driven refrigeration chiller which has a lubricant reservoir connected in parallel with the main line by which lubricant is supplied to the compressor during normal operation. When the main compressor lubricant supply line is blown dry, as can occur under certain chiller shutdown circumstances, it is immediately re-filled out of the reservoir. The reservoir remains sufficiently filled with lubricant, even after the oil supply line has been blown dry, to accomplish the purpose of re-filling a critical portion thereof. Once emptied, the reservoir is re-filled as the chiller next starts up and remains filled until such time as the main compressor lubricant supply line is again blown dry. In chiller systems in which a sensor is used to ensure the availability of lubricant to the compressor in a timely manner after a chiller start-up, providing for the immediate refilling of the main lubricant supply line, even after it has been blown dry, assures that the chiller will not be subject to repeated failed starts as a result of the failure of the sensor to sense lubricant in the critical chiller lubricant supply line location.

DESCRIPTION OF THE DRAWING FIGURES

DESCRIPTION OF THE PREFERRED EMBODIMENT

Figure 1:
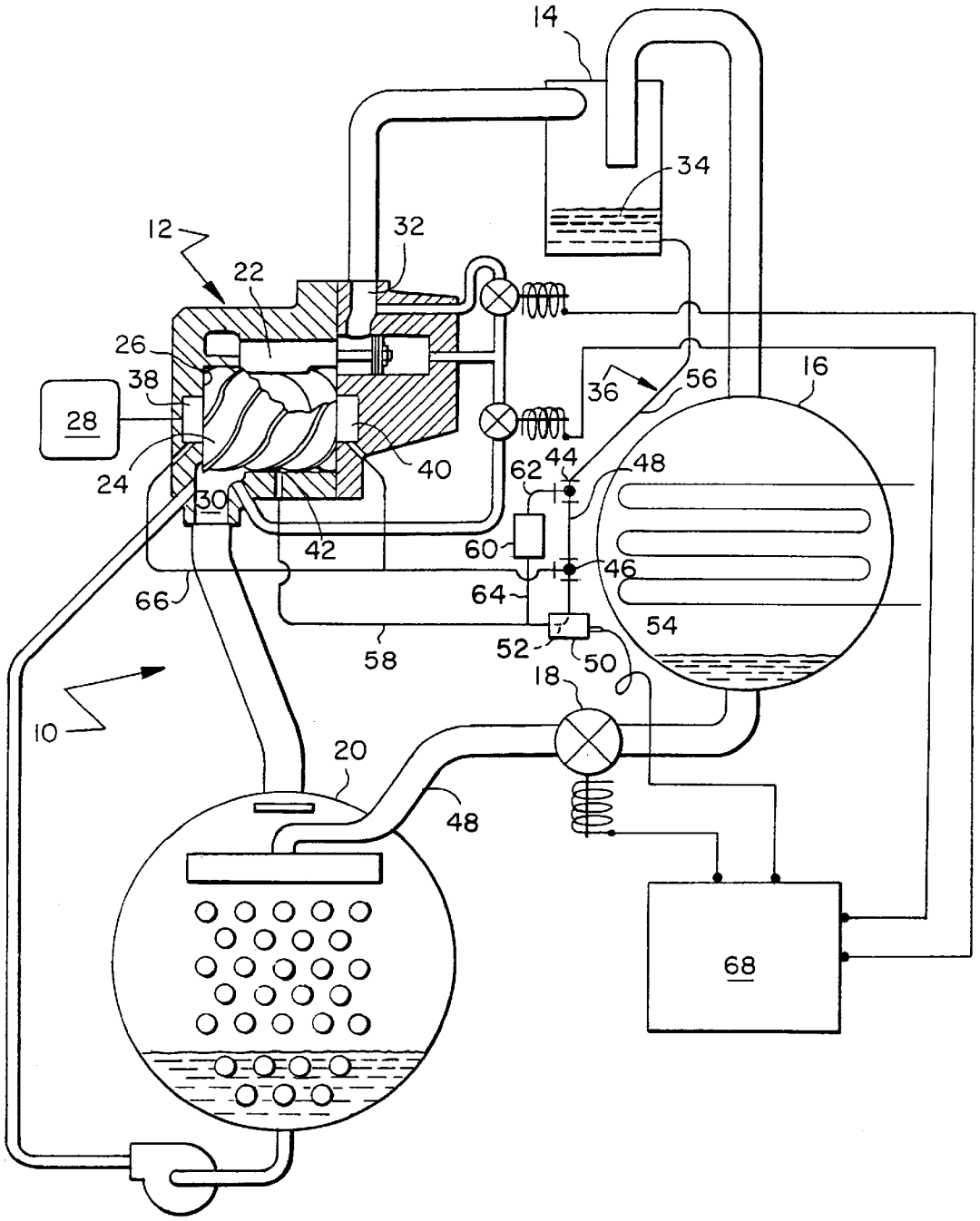
FIG. 1 is a schematic illustration of the refrigeration chiller of the present invention.

Referring first to FIG. 1, chiller system 10 includes a compressor 12, in oil separator 14, a condenser 16, an expansion valve 18 and an evaporator 20. All of these components are serially connected as a circuit for refrigerant flow as will more thoroughly be described.

Compressor 12 is, in the preferred embodiment, a compressor of the screw type in which screw rotors 22 and 24 are meshingly engaged in a working chamber 26. In a screw compressor of the type illustrated in FIG. 1, one of the screw rotors of compressor 12 is driven by a motor 28 when the chiller is in operation. Refrigerant gas is drawn into working chamber 26 of the compressor from evaporator 20 through suction area 30 of the compressor and is compressed by the intermeshing counter-rotation of the motor-driven screw rotors therein. The compressed gas is discharged from the working chamber 26 of the compressor into discharge area 32 thereof at significantly increased pressure and temperature.

By their nature, refrigeration screw compressors often require the delivery of a significant quantity of lubricant to them for multiple purposes, most typically associated with compressor lubrication, sealing and/or cooling needs. After or during its use for these purposes, the lubricant typically makes its way into the compressor's working chamber. Lubricant is driven to the locations of its use by the pressure differential that exists between the oil separator 14, which is at discharge pressure when the chiller is in operation and which is the source of the lubricant, and the relatively lower pressure locations of its use within the compressor.

The amount of lubricant that becomes entrained in the refrigerant gas flowing through the compressor's working chamber is significant. Such oil is carried out of the compressor to the oil separator where it is disentrained and drains to sump 34 therein. Because oil separator 14 and sump 34 are at discharge pressure and because the refrigerant gas and oil therein are relatively hot when the chiller is in operation, the oil in sump 34 of the oil separator can, because of such pressures and temperatures, contain on the order of 30% by weight of absorbed refrigerant.

The discharge pressure that exists internal of oil separator 14 drives lubricant from sump 34 through line 36 to, for instance, bearings 38 and 40 of the compressor and to oil injection port 42 which opens into the compressor's working chamber. The lubricant injected directly into the working chamber of the compressor and into the gas undergoing pressure therein through port 42 cools the refrigerant in the working chamber and/or provides a seal between the screw rotors and the inner wall of the working chamber. The lubricant directed to the bearings provides for the lubrication thereof.

Figure 2:
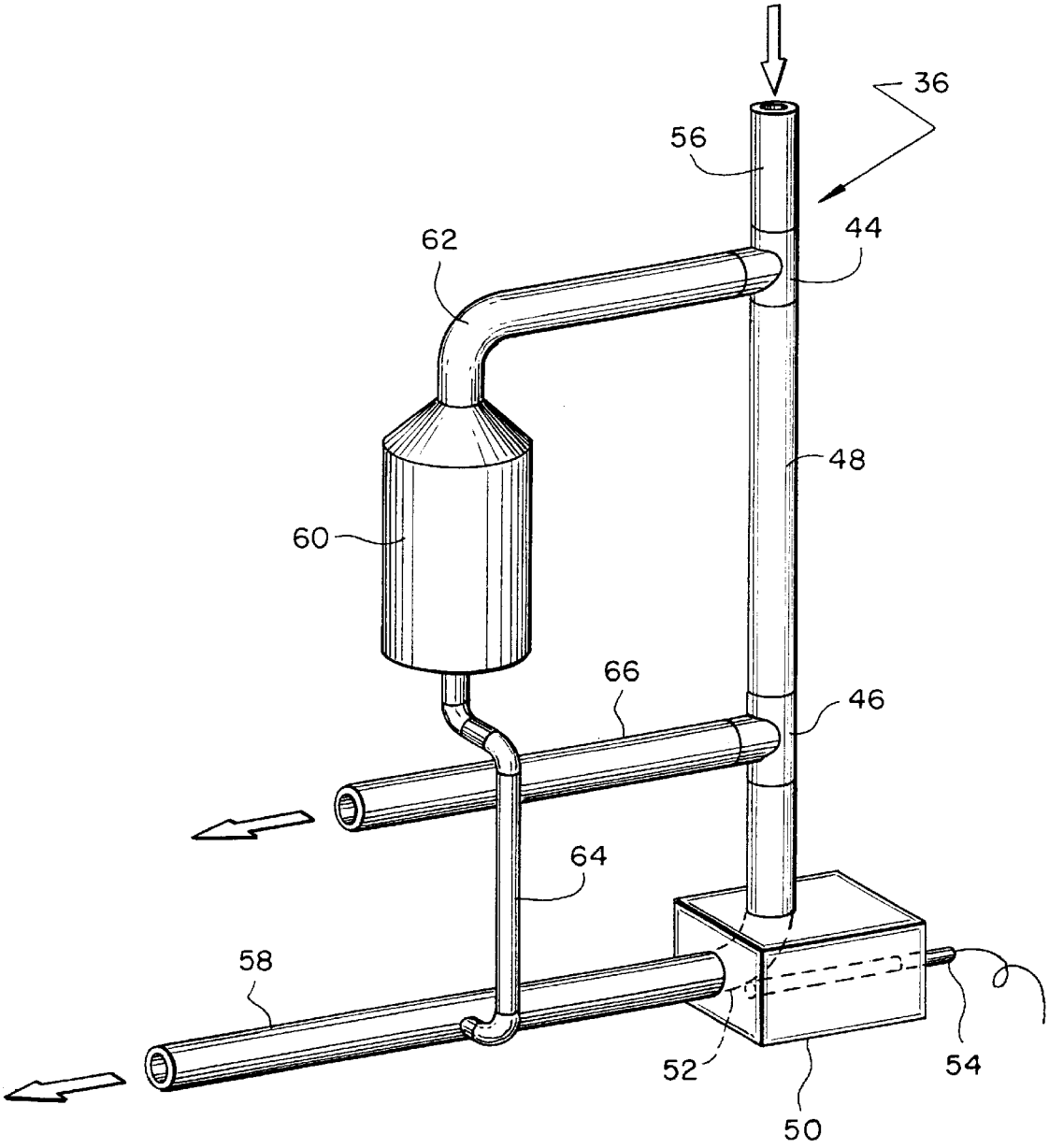
FIG. 2 is an illustration of the apparatus of the present invention by which the supply of lubricant to the compressor of the chiller of FIG. 1 is assured.

Referring additionally now to FIG. 2, chiller 10, in the preferred embodiment of the present invention, is provided with apparatus by which to assure that lubricant is made available to the compressor shortly after start-up and, in particular, is quickly made available to the compressor oil injection port even under the circumstance that the previous shutdown of the compressor and chiller system has caused the lubricant supply line leading from the oil separator to the injection port to be blown dry. In that regard, lubricant supply line 36 includes a first tee-section 44, a second tee-section 46, a section of piping 48 connecting the two tee-sections and a sensor block 50 that defines a flow path 52 through it which is in communication with a sensor 54. Lubricant is delivered from sump 34 of the oil separator to first tee-section 44 through piping section 56 of supply line 36. After next flowing through piping section 48, tee section 46 and flow path 52 of sensor block 50, the lubricant is delivered to the injection port of the compressor through piping section 58 which, during normal chiller operation and subsequent to normal chiller shutdowns, will typically retain and contain lubricant due to the importance of its purpose and/or its physical location in the context of the chiller assembly.

Piping section 66, which branches off from tee-section 46, may feed less critical compressor locations or may feed compressor locations that are less affected by blow-back through lubricant supply line 36, should it occur, due to its geometry and/or location in the context of the chiller assembly and/or due to the fact that it connects to the main line running from the sump in oil separator 14 to the compressor via a "tee". It is to be noted that in certain chiller designs and lubrication systems, second tee-section 46 may not exist at all or only a single line or more than two oil lines may feed lubricant to the compressor. Further, the compressor location fed by line 58 may be other than an injection port. All such possibilities are contemplated and fall within the scope of the present invention.

A lubricant reservoir 60 is in flow communication with first tee-section 44 and line 36 via conduit 62 and is likewise in flow communication with section 58 of lubricant supply line 36 through drain line 64. Reservoir 60, in the preferred embodiment, is sized so as to hold from 1.5 to 2.0 times the volume of lubricant that will typically reside in section 58 of the lubricant supply line. Conduit 62, through which lubricant flows into reservoir 60, is sized such that reservoir 60 fills, when empty, relatively quickly, preferably without diverting more than approximately 10 to 15 percent of the total oil flow through line 36 during the fill process. Drain line 64, on the other hand, is a much smaller line with the ratio between the flow areas through conduit 62 and through drain line 64 being, in the preferred embodiment, on the order or 16:1. By use of this ratio, reservoir 60, if empty, is, in the preferred embodiment, caused to be filled within about 45 seconds of a compressor re-start.

Under normal operating conditions, reservoir 60 remains filled because the rate at which it is filled, when oil is flowing through lubricant supply line 36, is greater than the rate at which lubricant drains out of reservoir 60 to section 58 of that lubricant supply line through drain line 64. Because of the free-flow relationship between reservoir 60 and the oil supply line through conduit 62 and drain line 64, some drainage and re-filling of the reservoir will continuously occur as oil flows through line 36. The rate/amount of drainage and re-filling will, however, be relatively small given the size of drain line 64.

Under the circumstance where section 58 of lubricant supply line 36 is dry and the pressure therein is such as to allow reservoir 60 to drain to it through drain line 64, the sizing of drain line 64 is such that it takes, in the preferred embodiment, approximately one minute for reservoir 60 to drain to and fill piping section 58. It is to be understood that reference to a "dry" lubricant supply line herein is not necessarily meant to suggest complete dryness of the line or that the line is entirely devoid of oil. It is only meant to convey the circumstance that much of the lubricant that would normally be found in the line has, for some reason, been displaced therefrom.

Under certain chiller shutdown circumstances, pressures within the chiller system, including those within the compressor, the oil separator and supply line 36, can and do change dramatically and quickly. Such conditions typically occur when the chiller shuts down under full or near full load, often due to a power interruption or another system condition that causes an emergency chiller shutdown. Such pressure transients most often last only on the order of 15 to 20 seconds. However, during such transient conditions, system pressures may be such as to cause the lubricant normally contained in lubricant supply line 36 to be blown thereoutof and back to the oil separator which, under such conditions, can momentarily be at a relatively lower pressure than the compressor locations it normally feeds.

Even during such transient pressure conditions oil will, in fact, be metered into section 58 of oil supply line 36 from reservoir 60 through drain line 64 because reservoir 60 is, once again, in open communication with line 36 through both conduit 62 and drain line 64. However, the amount of lubricant that drains into section 58 of the oil supply line under any circumstance, including this one, is limited by the size of drain line 64. Reservoir 60 is, accordingly, sized to account for the lubricant that will drain thereoutof through drain line 64 while transient pressure conditions exist and will, after such transient conditions subside, contain sufficient lubricant to essentially fill oil supply line 58 even if it has been blown dry. As a result, lubricant is immediately available in section 58 of the lubricant supply line when the chiller next attempts to start. This ensures that critical compressor locations are quickly supplied with lubricant, even if line 36 has been blown dry as a result of the circumstances of the preceding chiller shutdown, and assures that the re-start will be permitted to continue as a result of the existence and sensing of lubricant in section 58 by sensor 54.

Of significance with respect to the present invention is the fact that an assured supply of lubricant is provided to the compressor, even under circumstances where the lubricant supply line has been blown dry due to the nature of the preceding chiller shutdown, without the need for any proactive control of the process by which the assured supply of lubricant is provided and without the need for moving parts. This is because the reservoir is replenished from and drains to the lubricant supply line via a flow path that is continuous and unobstructed.

Also, in chiller systems where part of the chiller protection scheme includes the use of a sensor the purpose of which is to sense the existence of lubricant in the main lubricant supply line by which the compressor is fed, failure of the sensor to sense the existence of lubricant in the supply line when the chiller next attempts to start after the main lubricant supply line has been blown dry can cause repetitive compressor re-start failures and result in service calls. In the preferred embodiment of the present invention, sensor 54 is an optical sensor connected to chiller controller 68 which must optically sense the presence of a liquid within section 58 of the main lubricant supply line or controller 68 will not permit the chiller to start. Such failed re-starts and the need for such calls are, to a great extent, eliminated by the employment of the reservoir system of the present invention. Therefore, not only is the long-term reliability of the compressor enhanced by the present invention but the likelihood of repetitive failed re-starts and the need for service calls relating thereto is to a great extent reduced or eliminated.

While the present invention has been described in terms of a preferred embodiment, it will be appreciated that many modifications thereto will be apparent to those skilled in the art. In particular, it will be apparent that the apparatus of the present invention, while primarily designed for and used in refrigeration chillers driven by screw compressors, has application in a wide variety of compressor systems where there is a need to assure and prove lubricant flow to the compressor under circumstances where the compressor's oil supply line may have been blown dry or otherwise have been caused to drain, such as a result of the circumstance of the preceding compressor shutdown.

What is claimed is:

1. A refrigeration chiller system comprising:

a compressor;

a source of compressor lubricant;

a lubricant supply line, said lubricant supply line connecting said lubricant source and said compressor for flow; and a lubricant reservoir discrete from said lubricant source, said lubricant reservoir being connected to drain into said lubricant supply line.

2. The system according to claim 1 wherein said reservoir is replenished with lubricant from said lubricant source.

3. The system according to claim 2 wherein said reservoir is replenished with lubricant flowing from said lubricant source through said lubricant supply line.

4. The system according to claim 3 further comprising a conduit and a drain line, said reservoir being connected to said lubricant supply line by said conduit so as to be replenished therefrom and said reservoir being connected to said lubricant supply line by said drain line so as to drain thereto.

5. The system according to claim 4 wherein the cross-sectional flow area of said conduit is greater than the cross-sectional flow area of said drain line.

6. The system according to claim 5 wherein the flow path from said lubricant supply line through said conduit, through said reservoir and through said drain line into said lubricant supply line is continuous and unobstructed.

7. The system according to claim 6 wherein said drain line is connected so as to drain to a predetermined portion of said lubricant supply line and wherein said reservoir is sized in accordance with the volume in said predetermined portion of said lubricant supply line.

8. The system according to claim 7 wherein said drain line is sized to provide for the flow of lubricant therethrough at a predetermined flow rate.

9. The system according to claim 8 further comprising a sensor, said sensor preventing the start-up of said chiller system in the event that an inadequate amount of lubricant is sensed to exist in said predetermined section of said lubricant supply line by said sensor when said chiller attempts to start.

10. A refrigeration chiller comprising:

a screw compressor, said screw compressor defining a working chamber and having at least a first and a second screw rotor, said first and said second screw rotors being disposed in said working chamber;

an oil separator, said oil separator receiving refrigerant gas at a discharge pressure and in which lubricant is entrained from said compressor, said oil separator defining a sump and causing the disentrainment of the majority of said entrained lubricant from said compressor discharge gas, lubricant which is disentrained from said discharge gas within said oil separator draining to said sump;

an expansion device, said expansion device receiving refrigerant gas from said oil separator;

an evaporator, said evaporator receiving refrigerant from said expansion device, refrigerant gas being drawn from said evaporator by said compressor into the working chamber thereof;

a lubricant supply line, said lubricant supply line connecting said sump of said oil separator to said compressor;

a lubricant reservoir, said lubricant reservoir being discrete from said sump and being connected to deliver lubricant into said lubricant supply line at a predetermined location.

11. The refrigeration chiller according to claim 10 wherein said lubricant reservoir is connected to said predetermined location in parallel with said lubricant supply line.

12. The refrigeration chiller according to claim 11 wherein said reservoir is replenished by lubricant sourced from said oil sump.

13. The refrigeration chiller according to claim 12 wherein said reservoir is replenished by lubricant sourced from said oil sump which first flows from said sump through a portion of said lubricant supply line.

14. The refrigeration chiller according to claim 13 wherein the location in said lubricant supply line from which said reservoir is replenished is between said sump and said predetermined location into which lubricant is delivered from said reservoir.

15. The refrigeration chiller according to claim 14 further comprising a conduit and a drain line, said conduit connecting said reservoir to said lubricant supply line, said reservoir being replenished by lubricant that flows through said conduit, said drain line connecting said reservoir to said predetermined location in said lubricant supply line.

16. The refrigeration chiller according to claim 15 wherein the cross-sectional flow area of said conduit is greater than the cross-sectional flow area of said drain line.

17. The refrigeration chiller according to claim 15 wherein the flow path from said lubricant supply line through said conduit, through said reservoir and through said drain line into said lubricant supply line is continuous and unobstructed.

18. The refrigeration chiller according to claim 17 wherein said drain line is sized to provide for the flow of lubricant therethrough at a predetermined flow rate.

19. The refrigeration chiller according to claim 15 wherein said predetermined location to which said reservoir drains is in a predetermined portion of said lubricant supply line and wherein said reservoir is sized to provide a predetermined amount of lubricant to said predetermined portion of said lubricant supply line even if said predetermined portion of said supply line has been emptied of lubricant.

20. The refrigeration chiller according to claim 19 further comprising a sensor, said sensor preventing the start-up of said refrigeration chiller in the event that said predetermined portion of said lubricant supply line is determined by said sensor to have an inadequate amount of lubricant in it when said chiller system attempts to start.

21. A method of assuring the supply of lubricant to a compressor in a refrigeration chiller when the compressor starts up, comprising the steps of:

collecting lubricant in a sump in said chiller;

delivering lubricant from said sump to a reservoir;

delivering lubricant from said sump to the compressor through a lubricant supply line;

draining lubricant out of said reservoir and into said lubricant supply line at a predetermined location in said supply line; and replenishing said reservoir with lubricant sourced from said sump.

22. The method according to claim 21 wherein said draining step includes the step of metering lubricant out of said reservoir at a predetermined rate.

23. The method according to claim 22 wherein the rate at which lubricant drains out of said reservoir in said draining step is lower than the rate at which said reservoir is replenished with lubricant in said replenishing step.

24. The method according to claim 23 wherein said replenishing step includes the step of diverting a portion of the lubricant delivered from said sump to said compressor through said lubricant supply line in said step of delivering lubricant from said sump to said compressor into and through said reservoir.

25. The method according to claim 24 comprising the further step of sizing said reservoir so that it is able to provide a predetermined amount of lubricant through said drain line to said supply line in a predetermined period of time.

26. The method according to claim 25 wherein the flow of lubricant from said lubricant supply line to and through said reservoir in said diverting step and the flow of lubricant out of said reservoir to said predetermined location in said lubricant supply line in said draining step is through a continuous and unobstructed flow path.

27. The method according to claim 26 comprising the further step of preventing the start-up of said chiller in the event that an inadequate amount of lubricant is sensed to exist in the portion of said lubricant supply line to which said reservoir drains.

* * * * *